US009474111B2

(12) United States Patent
Harris

(10) Patent No.: US 9,474,111 B2
(45) Date of Patent: Oct. 18, 2016

(54) SOLID STATE LIGHTING APPARATUS INCLUDING SEPARATELY DRIVEN LED STRINGS AND METHODS OF OPERATING THE SAME

(71) Applicant: Cree, Inc., Durham, NC (US)

(72) Inventor: Michael James Harris, Cary, NC (US)

(73) Assignee: Cree, Inc., Durham, NC (US)

( * ) Notice: Subject to any disclaimer, the term of this patent is extended or adjusted under 35 U.S.C. 154(b) by 593 days.

(21) Appl. No.: 13/760,647

(22) Filed: Feb. 6, 2013

(65) Prior Publication Data

US 2014/0217907 A1 Aug. 7, 2014

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.
CPC ..... *H05B 33/0815* (2013.01); *H05B 33/0824* (2013.01); *H05B 33/0866* (2013.01)

(58) Field of Classification Search
USPC ..... 315/185 R, 186–193, 185 S
See application file for complete search history.

(56) References Cited

U.S. PATENT DOCUMENTS

| | | | | |
|---|---|---|---|---|
| 2007/0115228 | A1 | 5/2007 | Roberts et al. | |
| 2007/0115662 | A1 | 5/2007 | Roberts et al. | |
| 2008/0202312 | A1* | 8/2008 | Zane | G09G 3/342 84/297 R |
| 2011/0068699 | A1* | 3/2011 | Knapp | 315/158 |
| 2011/0204797 | A1* | 8/2011 | Lin | H05B 33/0827 315/161 |
| 2011/0210678 | A1* | 9/2011 | Grajcar | 315/192 |
| 2012/0200229 | A1* | 8/2012 | Kunst et al. | 315/186 |
| 2012/0229032 | A1* | 9/2012 | Van De Ven et al. | 315/151 |
| 2012/0326613 | A1* | 12/2012 | Liu | G09G 3/342 315/185 R |
| 2013/0026923 | A1 | 1/2013 | Athayle et al. | |
| 2013/0069535 | A1 | 3/2013 | Athayle | |
| 2013/0069536 | A1 | 3/2013 | Ni | |
| 2013/0069547 | A1* | 3/2013 | van de Ven et al. | 315/188 |
| 2013/0082613 | A1* | 4/2013 | Shin | H05B 33/0827 315/186 |
| 2013/0293151 | A1* | 11/2013 | Puvanakijjakorn et al. | 315/297 |
| 2014/0159612 | A1* | 6/2014 | Tong | 315/297 |
| 2014/0252967 | A1* | 9/2014 | van de Ven et al. | 315/188 |

OTHER PUBLICATIONS

Lutron, Diva 0-10V Control, Retrieved from the internet on Apr. 18, 2013 at URL http://www.lutron.com/technicaldocumentlibrary/diva_0-10Vsubmittal.pdf.

U.S. Appl. No. 13/416,613, Antony P. van de Ven et al., "Methods and Circuits for Controlling Lighting Characteristics of Solid State Lighting Devices and Lighting Apparatus Incororating Such Methods and/or Circuits", filed Mar. 9, 2012.

* cited by examiner

*Primary Examiner* — Brandon S Cole
(74) *Attorney, Agent, or Firm* — Myers Bigel & Sibley, P.A.

(57) ABSTRACT

A solid state lighting apparatus can include a first string of Light Emitting Diodes (LEDs) that is configured to operate in response to a rectified ac voltage having a cycle including a null time interval when the first string is off and a second string of LEDs, that is separate from the first string of LEDs, and can be configured to emit light during at least a portion of the null time interval.

26 Claims, 8 Drawing Sheets

SOLID STATE LIGHTING APPARATUS INCLUDING SEPARATELY DRIVEN LED STRINGS AND METHODS OF OPERATING THE SAME

FIELD OF THE INVENTION

The invention relates to the field of lighting in general, and more particularly, to solid state lighting.

BACKGROUND

It is known to provide a solid state lighting apparatus, such as one including Light Emitting Diodes (LEDs), that operates in response to a rectified ac voltage. In some conventional lighting devices, segments of the LED string can be separately biased so that as the magnitude of the rectified ac voltage increases, additional segments of the LED string can be forward biased so that light is provided in a sequentially increasing manner. Moreover, as the magnitude of the rectified ac voltage signal decreases (i.e. passes 90 degrees of phase) the separate LED segments are deactivated in reverse order. Accordingly, in some portions of the rectified ac voltage cycle, none of the segments are forward biased, which can be referred to as a "null time interval" when no light is emitted by the string.

It is also known to couple a dimmer switch (such as a phase cut dimmer switch) to an LED lighting apparatus so that the intensity of the light emitted by the apparatus can be adjusted.

SUMMARY

Embodiments according to the invention can provide a solid state lighting apparatus that includes separate LED strings and methods of operating. Pursuant to these embodiments, a solid state lighting apparatus can include a first string of Light Emitting Diodes (LEDs) that is configured to operate in response to a rectified ac voltage having a cycle including a null time interval when the first string is off and a second string of LEDs, that is separate from the first string of LEDs, and can be configured to emit light during at least a portion of the null time interval.

In some embodiments according to the invention, the null time interval includes a phase cut dimming time interval during the cycle. In some embodiments according to the invention, the null time interval includes an off time interval when the rectified ac voltage applied to the first string of LEDs is less than a forward bias voltage for a first LED in the first string of LEDs. In some embodiments according to the invention, the apparatus can further include a first driver circuit that is configured to provide a first current to the first string of LEDs that changes with a phase of the rectified ac voltage and a second driver circuit that is configured to provide a second current to the second string of LEDs that is substantially constant as the phase of the rectified ac voltage changes.

In some embodiments according to the invention, the second driver circuit is further configured to provide the second current outside the null time interval. In some embodiments according to the invention, the apparatus further includes a first driver circuit that is configured to bias the first string of LEDs so that all of the LEDs in the first string of LEDs remain off during the null time interval and that is configured to forward bias the LEDs in the first string of LEDs according to a sequence outside the null time interval. In some embodiments according to the invention, the apparatus further includes a second driver circuit that is configured to bias the second string of LEDs so that all of the LEDs in the second string of LEDs remain on during the null time interval.

In some embodiments according to the invention, the apparatus further includes a second driver circuit that is configured to bias the second string of LEDs so that at least one of the LEDs in the second string of LEDs is forward biased during the null time interval. In some embodiments according to the invention, the apparatus further includes a second driver circuit includes a DC/DC converter circuit that is configured to bias the second string of LEDs to emit a substantially constant level of light over the cycle of the rectified ac voltage.

In some embodiments according to the invention, the DC/DC converter circuit includes a boost circuit that is coupled to the rectified ac voltage and that is configured to provide a substantially constant dc current to the second string of LEDs over the cycle of the rectified ac voltage. In some embodiments according to the invention, the DC/DC converter circuit includes a switched mode power supply circuit coupled to the rectified ac voltage and that is configured to provide a constant dc current to the second string of LEDs over the cycle of the rectified ac voltage.

In some embodiments according to the invention, the DC/DC converter circuit includes a switch configured to control power delivery to the second string of LEDs by modifying a duty cycle of a pulse width modulation signal provided to the switch, to reduce the constant dc current. In some embodiments according to the invention, the first string of LEDs and the second string of LEDs include identical colors of LEDs and the first string of LEDs is configured to emit about a first percent of a total lumen output of the apparatus and the second string of LEDs is configured to emit about a second percent of the total lumen output, wherein the first and second percents are configured to maintain the total lumen output on a black body radiator curve at a respective color temperature. In some embodiments according to the invention, the first string of LEDs includes blue-shifted-yellow LEDs configured to output about 80 percent of a total lumen output of the apparatus and the second string of LEDs includes red LEDs configured to output about 20 percent of the total lumen output.

In some embodiments according to the invention, a method of operating a solid state lighting apparatus can be provided by driving a first string of Light Emitting Diodes (LEDs) in response to a rectified ac voltage having a cycle including a null time interval when the first string is off and driving a second string of LEDs, separate from the first string of LEDs, to emit light during at least a portion of the null time interval.

In some embodiments according to the invention, the null time interval includes a phase cut dimming time interval during the cycle. In some embodiments according to the invention, the null time interval includes an off time when the rectified ac voltage applied to the first string of LEDs is less than a forward bias voltage for a first LED in the first string of LEDs. In some embodiments according to the invention, the method further includes providing a first current to the first string of LEDs that changes with a phase of the rectified ac voltage and providing a second current to the second string of LEDs that is substantially constant as the phase of the rectified ac voltage changes.

In some embodiments according to the invention, a solid state lighting apparatus can include a first string of Light Emitting Diodes (LEDs) that is configured to operate in response to a rectified ac voltage having a cycle including a low light emission level interval when the first string emits a low light emission level and a second string of LEDs, separate from the first string of LEDs, that is configured to emit light during at least a portion of the low light emission level interval.

In some embodiments according to the invention, the low light emission level is sufficient to provide a phase cut dimming associated modulation depth initiating perceptible flicker. In some embodiments according to the invention, the light emitted from the second string of LEDs during at least a portion of the low light emission level interval is sufficient to reduce perceptible flicker generated by the phase cut dimming associated modulation depth.

In some embodiments according to the invention, a solid state lighting apparatus can include a first string of Light Emitting Diodes (LEDs) that are configured to operate in response to a rectified ac voltage having a cycle including a null time interval when the first string is off and a second string of LEDs, that can be coupled in series with the first string of LEDs, which is configured to emit light during at least a portion of the null time interval.

DETAILED DESCRIPTION OF EMBODIMENTS ACCORDING TO THE INVENTION

Figure 1:
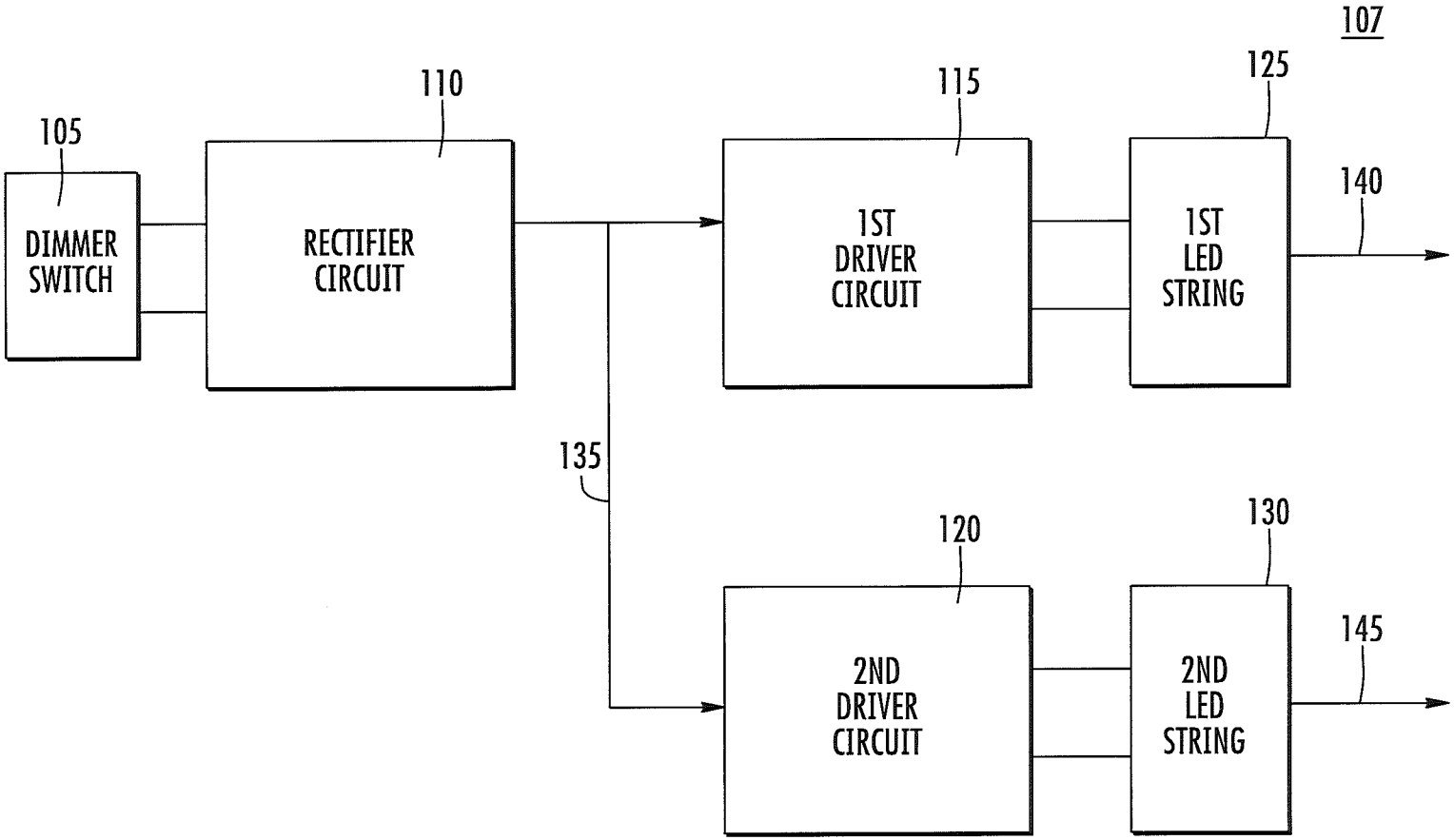
FIG. 1 is a block diagram that illustrates a solid state lighting apparatus including first and second driver circuits connected to separate first and second LED strings in some embodiments according to the invention.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing ac incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

As described herein below in greater detail, as appreciated by the present inventor, in some embodiments according to the invention, when a phase cut dimmer switch is coupled to an LED lighting apparatus, a number of detrimental lighting artifacts may be generated. In particular, as the depth of modulation provided by the phase cut dimming increases, flicker may be more perceptible due to the increasingly greater modulation depth generated when the phase cut dimming time interval ends and the LED string is activated. For example, when the phase cut dimming time interval ends at about 90 degrees of phase in a 120 Hz rectified ac voltage signal, the modulation depth, when the phase cut dimming time ends, may exacerbate flicker. Still further, when the rectified ac voltage level is reduced to a level where all of the LEDs in the LED string are deactivated, additional off time (i.e. time when no light is generated by the LED string) can further increase perceptible flicker.

As appreciated by the present inventor, these two artifacts may be addressed by providing separate first and second LED strings, which can be driven separately. For example, in some embodiments according to the invention, the first LED string can be driven with the rectified ac voltage as provided by the phase cut dimmer switch to supply a current that varies with the phase of the rectified ac voltage, whereas the second LED string can be driven by, for example, providing a constant current that does not substantially change with the phase of the rectified ac voltage. In some embodiments according to the invention, the separate first and second LED strings can be separate sub-sets of a common LED string. In some embodiments according to the invention, the separate first and second LED strings can each include at least one respective LED.

The combined effect of driving the separate LED strings differently can reduce the depth of modulation at the end of the phase cut dimming time interval. In particular, the second LED string can emit some light when the first LED string is essentially "off" so that when the first LED string turns on at the end of the phase cut dimming time interval, the change in the light output can be perceived as less, thereby allowing a reduction in perceptible flicker. For example, in some embodiments according to the invention, the second LED string can be activated during the time (or at least some portion of the time) when the phase cut dimming deactivates the first LED string. Furthermore, the second LED string can also be activated (during at least some portion of the time) when the first LED string is deactivated due to the reduced level of the rectified ac voltage signal.

In still other embodiments according to the invention, the second LED string can be activated only during the phase cut dimming time interval and/or the time when the first LED string is deactivated, due to the level of the rectified ac voltage provided to the first LED string. For example, in some embodiments according to the invention, the second LED string may be activated when none of the LEDs in the first LED string are forward biased. Accordingly, the light output from the two separate LED strings can be combined to provide a combined output from the apparatus which may reduce perceptible flicker. In particular, the light output from the second LED string may reduce perceptible flicker by providing some light output from the apparatus when the first LED string is otherwise deactivated due to the reduced level of the rectified ac voltage signal.

In some embodiments according to the invention, the LEDs strings can include any type or combination of types of LEDs. For example, the first and second LED strings can both include white LEDs, where the first and second LED strings can be driven as described herein, where, for example, the second LED string of white LEDs is driven with a substantially constant current level when the first LED string of white LEDs is de-activated either due to the phase cut dimming or due to the "off" time (or at least some portion of these times). This approach may allow the apparatus to provide good quality light, while reducing perceived flicker by reducing the depth of modulation associated with the phase cut dimming, as well as increasing the intensity of the light emitted during the "off" time.

In some embodiments according to the invention, the first LED string can include BSY LEDs and can be configured to emit a fraction of the total lumen output of the apparatus, whereas the second LED string can include red LEDs and can be configured to output the remaining portion of the total lumen output. For example, in some embodiments according to the invention, the first LED string can include BSY LEDs and can be configured to emit about 80% of the total lumen output of the apparatus, whereas the second LED string can include red LEDs and can be configured to output about 20% of total lumen output. Moreover, the lumen outputs of the first and second LED strings can be provided as described herein, where, for example, the red LEDs are driven with a substantially constant current level when the first string of LEDs is de-activated either due to the phase cut dimming or due to the "off" time (or at least some portion of the phase cut dimming time interval or the "off time").

Figure 5:
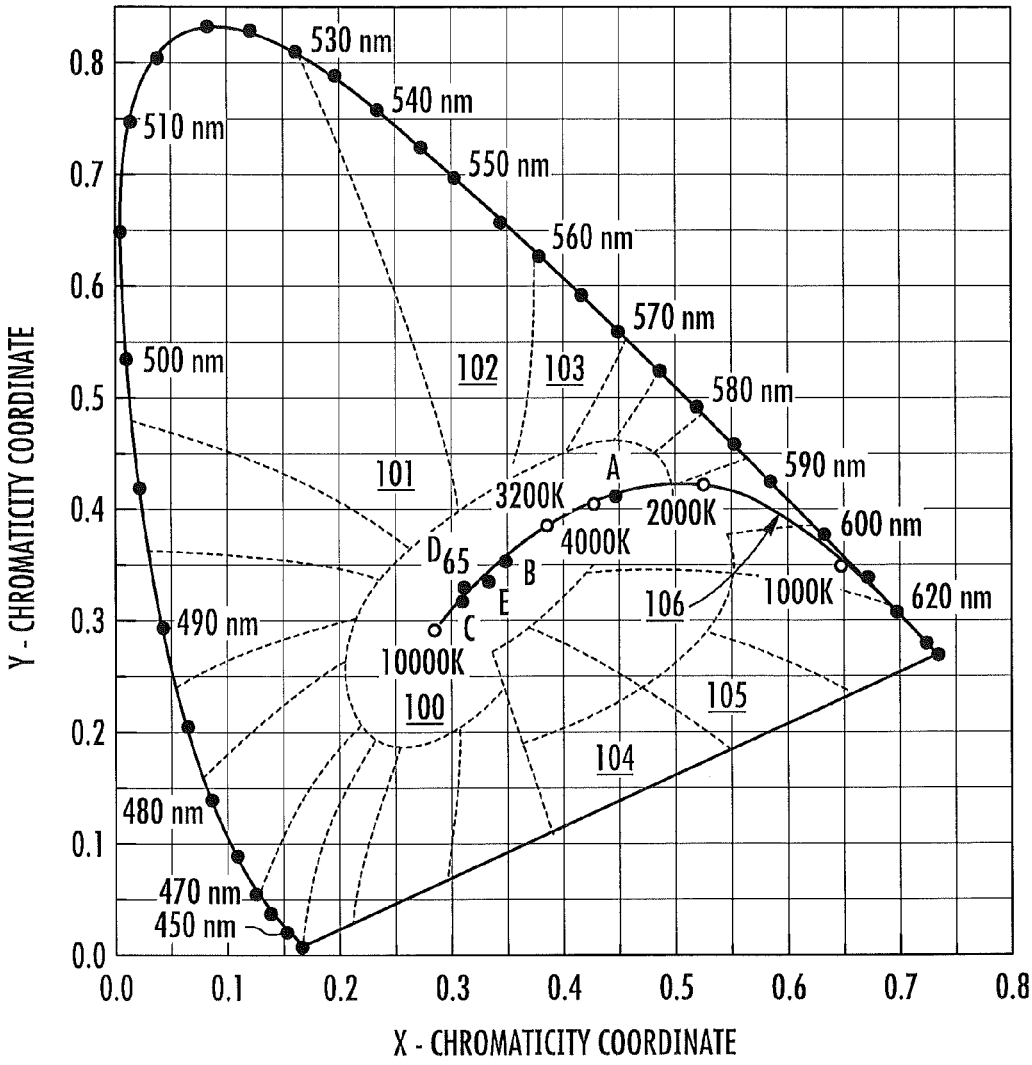
FIG. 5 is a 1931 CIE chromaticity diagram.

It will be understood that the lumen output from the BSY LEDs and the red LEDs can combine to approximate a white (or warm white) light, by following the planckian locus 106 shown in FIG. 5. Accordingly, the fractions of the total lumen output from the apparatus can be chosen so that the emitted light approximates incandescent lighting by following the planckian locus 106. For example, in some embodiments according to the invention, the apparatus can be configured so that 20% of the total lumen output is produced using red LEDs and 80% is generated using BSY LEDs, so that the emitted light resembles incandescent lighting. Accordingly, it may be more efficient to include the red LEDs in the second LED string because of the cost of the active power conversion associated with the second driver circuit, as only 20% of the power (i.e., lumens) is managed by the active power conversion provided by the second driver circuit etc.

FIG. 1 is a block diagram illustrating a solid state lighting apparatus 107 including a first driver circuit 115 coupled to a first LED string 125 and a second driver circuit 120 coupled to a second LED string 130 that is separate from the first LED string 125 in some embodiments according to the invention. As shown in FIG. 1, the first LED string 125 can provide a first light 140 output from the apparatus 107, whereas the second LED string 130 can provide a second light 145 output from the apparatus 107. The first and second light 140 and 145 may be perceived as combined.

It will be understood that the first and second LED strings 125 and 130 are described as being "separate" due to the fact that the two LED strings are responsive to different voltage signals that can be simultaneously and/or separately applied to the first and second LED strings 125 and 130. For example, the first and second LED strings 125 and 130 are separate as the first LED string 125 can operate responsive to a rectified ac voltage signal, whereas the second LED string 130 can operate responsive to a voltage signal that does not change according to the phase of the rectified ac voltage signal applied to the first LED string 125. Still further, in some embodiments according to the invention, the first and second LED strings 125 and 130 can separate from one another while being coupled together in a common LED string. For example, the first and second LED string 125 and 130 can be configured to be respective sub-sets of a common LED string. In operation, the second string of LEDs can be driven by the voltage signal that does not change according to the phase of the rectified ac voltage signal when the first string of LEDs is essentially dark, such as when the voltage level applied to the first string of LEDs causes very little light to be emitted by the first string. Still further, in some embodiments, the second string of LEDs 130 can be inactive when the first string of LEDs 125 becomes active. It will be understood, therefore, that is some embodiments according to the invention, the first and second LED strings 125 and 130 are coupled together in series with one another to provide the common LED string, so that the first and second LED strings 125 and 130 can be driven separately by the different voltage signals.

Figure 7:
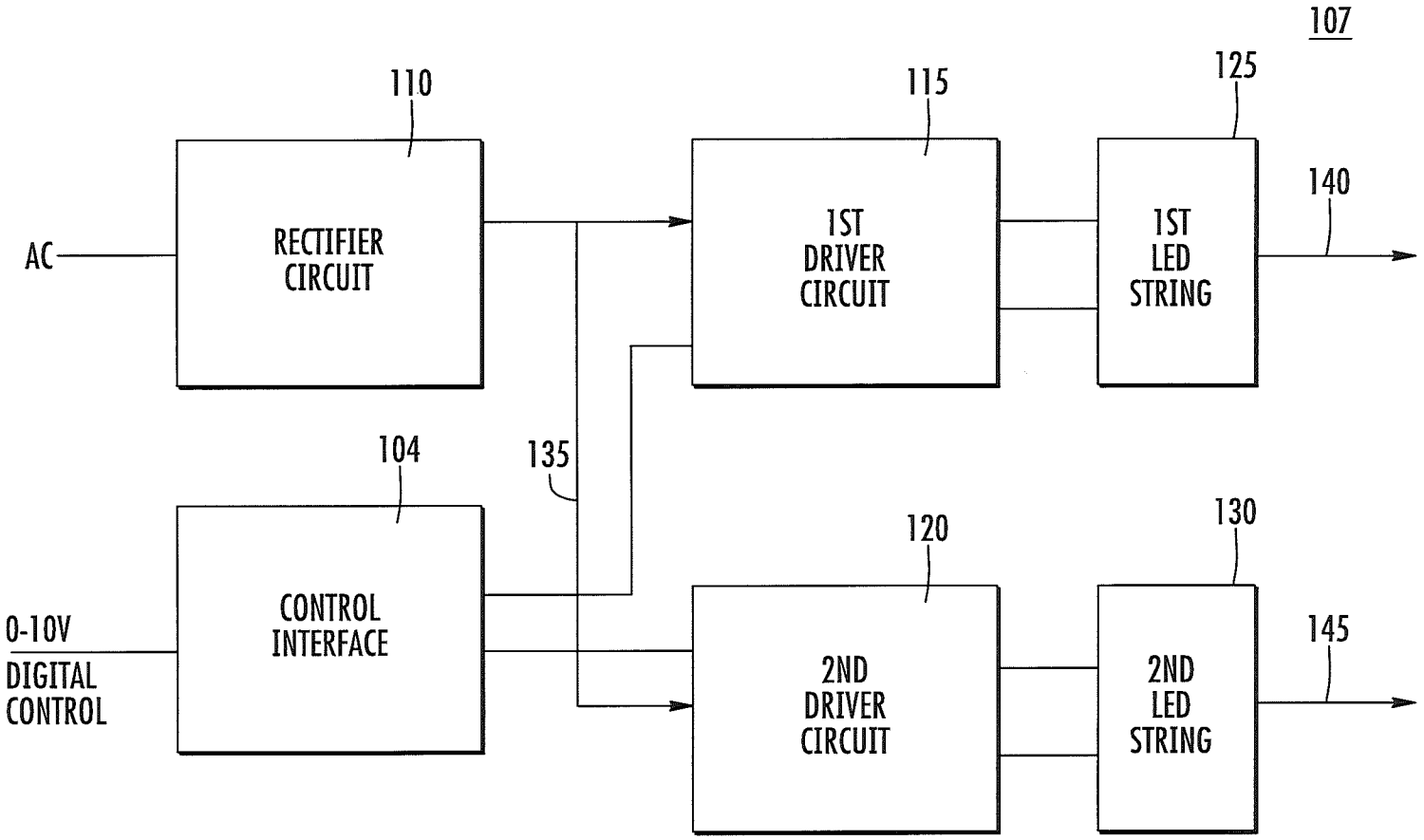
FIG. 7 is a block diagram that illustrates a solid state lighting apparatus including first and second driver circuits connected to separate first and second LED strings and connected to a digital control interface for dimming in some embodiments according to the invention.

According to FIG. 1, an ac voltage signal is provided to a rectifier circuit 110 by a dimmer switch 105. It will be understood that the dimmer switch 105 can provide the ac voltage signal in accordance with what is referred to as "phase cut dimming" where, for example, the level of the ac voltage signal remains essentially zero up until a specified phase of the cycle. Beyond the specified phase, the ac voltage signal would not be clamped to zero. For example, in some embodiments according to the invention, the dimmer switch 105 may be configured to dim the light provided by the apparatus 107 by clamping the ac voltage signal to zero up until 90 degrees of phase within the ac voltage signal, whereafter the rectified ac voltage signal would not be clamped for the remainder of the phase It will be further understood that the phase cut dimming provided by the dimmer switch 105 can be leading phase cut dimming or trailing phase cut dimming. In some embodiments according to the invention, the dimmer switch 105 can provide 0-10V dimming. In some embodiments according to the invention, the dimmer switch 105 can provide dimming control using a digital interface, such as those described on the Internet at http://www.lutron.com/TechnicalDocumentLibrary/Diva_0-10Vsubmittal.pdf, the entirety of which is hereby incorporated by reference. Accordingly, the first driver circuit 115 may, in some embodiments, be implemented to have either an analog or digital control interface 104 to allow for either 0-10 V dimming (analog) or, for example, a $I^2C$ or Lutron type interface (digital) as shown in FIG. 7, which may cause the current level to increase/decrease during dimming whereas the second driver circuit can be configured to operate the second LED string 130 as described herein.

The rectifier circuit 110 provides a rectified ac voltage signal 135 to the first and second driver circuits 115 and 120. In some embodiments according to the invention, the rectified ac voltage signal 135 can have a frequency of about 120 Hz where, for example, the ac voltage signal provided to the rectifier circuit 110 has a frequency of about 60 Hz. It will be understood, however, that embodiments according to the invention can utilize ac voltage signals having any useable frequency.

In addition to the clamping provided by the phase cut dimming described above, the nature of the rectified ac voltage signal is such that when the rectified ac voltage signal is reduced below a particular level, the first driver circuit 115 may not provide a forward bias for any of the LEDs included in the first LED string 125 so that the first light 140 is reduced to zero (i.e., the first LED string 125 turns off). Therefore, both the phase cut dimming time interval of the rectified ac voltage signal cycle and this "off time" portion of the cycle (where the magnitude of the rectified ac voltage 135 is too low to forward bias any of the LEDs in the first LED string 125) are referred to as the "null time," as no light is emitted from the first LED string 125.

The rectified ac voltage signal 135 is also provided to the second driver circuit 120 to drive the second LED string 130 to provide the second light 145. The second driver circuit 120 is configured to bias the second LED string 130 to emit the second light 145 during at least some portion of one of the times described above (i.e., at least some portion of the phase cut dimming time interval or the "off time"). In particular, the second driver circuit 120 is configured to activate the second LED string 130 during the phase cut dimming time interval where the first light 140 from the first LED string 125 is zero. Still further, the second driver circuit 120 can be configured to bias the second LED string 130 to emit the second light 145 when the first LED string 125 is off due to the reduced level of the rectified ac voltage signal.

In some embodiments according to the invention, the second driver circuit 120 can be configured to bias the second LED string 130 to emit the second light 145 when the first LED string 125 is not entirely off, but rather emits a relatively low level of light (i.e., a low light emission level) which would be sufficient, if unaddressed, to provide a depth of modulation that would initiate perceptible flicker, particularly associated with phase cut dimming. In such embodiments according to the invention, the first and second light 140 and 145 can be combined to reduce the modulation depth (relative to the low light emission level) associated with the phase cut dimming and provide a greater level of light output to reduce perceptible flicker.

Various types of LEDs can be used in the first and second LED strings 125 and 130 to provide lighting products having a relatively high color rendering index (CRI). One approach to providing high CRI lighting is to use "white LED lights" (i.e., lights which are perceived as being white or near-white). A representative example of a white LED lamp includes a package of a blue light emitting diode chip, made of gallium nitride (GaN), coated with a phosphor such as YAG. In such an LED lamp, the blue light emitting diode chip produces a blue emission and the phosphor produces yellow fluorescence on receiving that emission, which is sometimes referred to as blue-shifted-yellow (BSY). For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

More specifically, a "BSY LED" refers to a blue LED and an associated recipient luminophoric medium that together emit light having a color point that falls within a trapezoidal "BSY region" on the 1931 CIE Chromaticity Diagram defined by the following x, y chromaticity coordinates: (0.32, 0.40), (0.36, 0.48), (0.43, 0.45), (0.42, 0.42), (0.36, 0.38), (0.32, 0.40), which is generally within the yellow color range, see for example, FIG. 5. A "BSG LED" refers to a blue LED and an associated recipient luminophoric medium that together emit light having a color point that falls within a trapezoidal "BSG region" on the 1931 CIE Chromaticity Diagram defined by the following x, y chromaticity coordinates: (0.35, 0.48), (0.26, 0.50), (0.13, 0.26), (0.15, 0.20), (0.26, 0.28), (0.35, 0.48), which is generally within the green color range. A "BSR LED" refers to a blue LED that includes a recipient luminophoric medium that emits light having a dominant wavelength between 600 and 720 nm in response to the light emitted by the blue LED. A BSR LED will typically have two distinct spectral peaks on a plot of light output versus wavelength, namely a first peak at the peak wavelength of the blue LED in the blue color range and a second peak at the peak wavelength of the luminescent materials in the recipient luminophoric medium when excited by the light from the blue LED, which is within the red color range. Typically, the red LEDs and/or BSR LEDs will have a dominant wavelength between 600 and 660 nm, and in most cases between 600 and 640 nm.

As shown in FIG. 5, colors on the 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 5. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 5 generally appears magenta (i.e., red-purple or purplish red).

Further, light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 5 is the planckian locus 106, which corresponds to the location of color points of light emitted by a black-body radiator that is heated to various temperatures. In particular, FIG. 5 includes temperature listings along the black-body locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the black-body locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the planckian locus. Accordingly, a white point may be identified by a correlated color temperature (CCT) of the light source. White light typically has a CCT of between about 2000 K and 8000 K. White light with a CCT of 4000 may appear yellowish in color, while light with a CCT of 8000 K may appear more bluish in color. Color coordinates that lie on or near the black-body locus at a color temperature between about 2500 K and 6000 K may yield pleasing white light to a human observer.

"White" light also includes light that is near, but not directly on the planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the planckian locus may be considered to have the same color as the point on the planckian locus.

The use of these types (and other) LEDs can promote truer color reproduction, which is typically measured using the Color Rendering Index (CRI). CRI is a relative measurement of how the color rendition of an illumination system compares to that of a blackbody radiator, i.e., it is a relative measure of the shift in surface color of an object when lit by a particular lamp. The CRI equals 100 if the color coordinates of a set of test colors being illuminated by the illumination system are the same as the coordinates of the same test colors being irradiated by the blackbody radiator. Daylight has the highest CRI (of 100), with incandescent bulbs being relatively close (about 95), and fluorescent lighting being less accurate (70-85). Certain types of specialized lighting have relatively low CRI's (e.g., mercury vapor or sodium, both as low as about 40 or even lower). Sodium lights are used, e.g., to light highways. Driver response time, however, significantly decreases with lower CRI values (for any given brightness, legibility decreases with lower CRI).

Figure 2A:
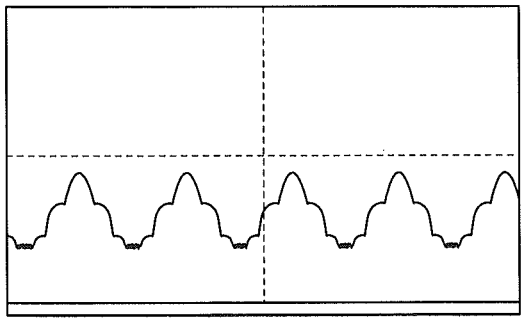
FIG. 2A is a graph illustrating a current waveform generated by driving an LED string in some embodiments according to the invention.
Figure 2B:
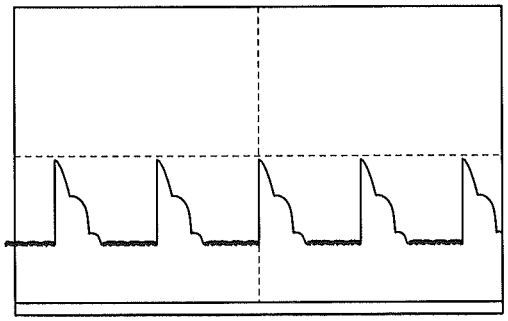
FIG. 2B is a graph illustrating a current waveform generated by driving an LED string with a phase cut dimming switch in some embodiments according to the invention.
Figure 2C:
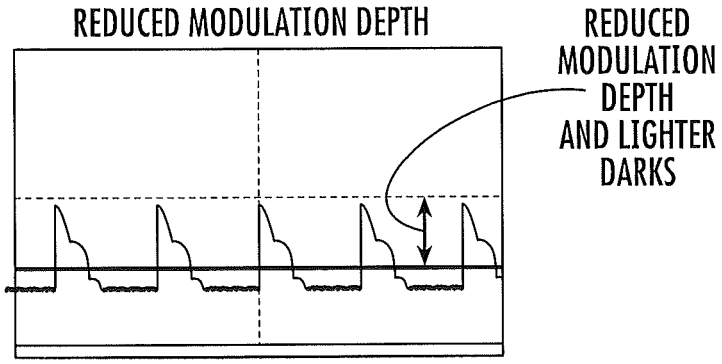
FIG. 2C is a graph illustrating first and second current waveforms generated by driving separate first and second LED strings in some embodiments according to the invention.

FIGS. 2A-2C are graphs that illustrate current waveforms associated with the first and second driver circuits 115 and 120 and first and second LED strings 125 and 130 in some embodiments according to the invention. According to FIG. 2A, a current waveform is generated through the first LED string 125 as shown when no phase cut dimming is provided as part of the rectified ac voltage signal 135. It will be understood that the current waveform in FIG. 2A includes what is sometimes referred to as "ripple current" associated with the voltage levels provided to the string so as to separately bias segments of the LED string 125. For example, as the rectified ac voltage signal 135 increases from zero (phase=zero) the first driver circuit progressively provides forward voltages sufficient to forward bias each of the segments in the string 125 so that the current through the string 125 increases in the steps shown. Likewise, as the rectified ac voltage signal 135 passes 90 degrees of phase, the voltage level begins reducing so that the segments of the string 125 turn off in the reverse order in which the segments were activated. Accordingly, the current provided by the first driver circuit 115 to the first LED string 125 varies with the phase of the rectified ac voltage signal 135. It will be understood that FIG. 2A does not show operation of the second string 130.

It will be understood that the term "segment" refers to a separately biased portion of an LED string. A segment can include at least one LED device, which can itself include a number of serially connected epi junctions used to provide a device that has a particular forward voltage, such as 3V, 6V, 9V, etc. where a single epi junction may have a forward voltage of about 1.5 volts. Each segment may include multiple LEDs that are connected in various parallel and/or serial arrangements. The segments LEDs may be configured in a number of different ways and may have various compensation circuits associated therewith, as discussed, for example, in commonly assigned co-pending U.S. application Ser. No. 13/235,103. U.S. application Ser. No. 13/235,127.

According to FIG. 2B, the dimmer switch 105 is configured to activate the phase cut dimming at about 90 degrees of phase so that during the first 90 degrees of phase in the rectified ac voltage signal 135, the first LED string 125 is deactivated, referred to as the "phase cut dimming time interval." After passing 90 degrees of phase, however, the first LED string 125 is driven by the first driver circuit 115 so that all of the segments in the string 125 are forward biased to emit the first light 140. Similar to the operation described above, after passing 90 degrees of phase, the rectified ac voltage level is progressively reduced so that the segments of the string 125 turn off in the reverse order in which the segments were activated. Accordingly, the current provided by the first driver circuit 115 to the first LED string 125 varies with the phase of the rectified ac voltage signal 135 outside the phase cut dimming time interval. It will be understood that FIG. 2B also does not show the operation of the second LED string 130.

According to FIG. 2C, the current waveform in FIG. 2B, is shown superimposed with an exemplary constant current provided to the second LED string 130 by the second driver circuit 120 to provide the second light 145. The current provided to the second LED string 130 generates the second light output 145 during the phase cut dimming time interval, as well as during the "off" time when the first LED string 125 is normally deactivated due to the level of the rectified ac voltage signal being insufficient to forward bias any of the segments in the first LED string 125. Accordingly, the first and second light 140 and 145 are perceived together in time to reduce the depth of modulation otherwise associated with the end of the phase cut dimming time interval and to increase the light output level otherwise associated with the "off" time due to reduce perceived lighting artifacts.

Figure 2D:
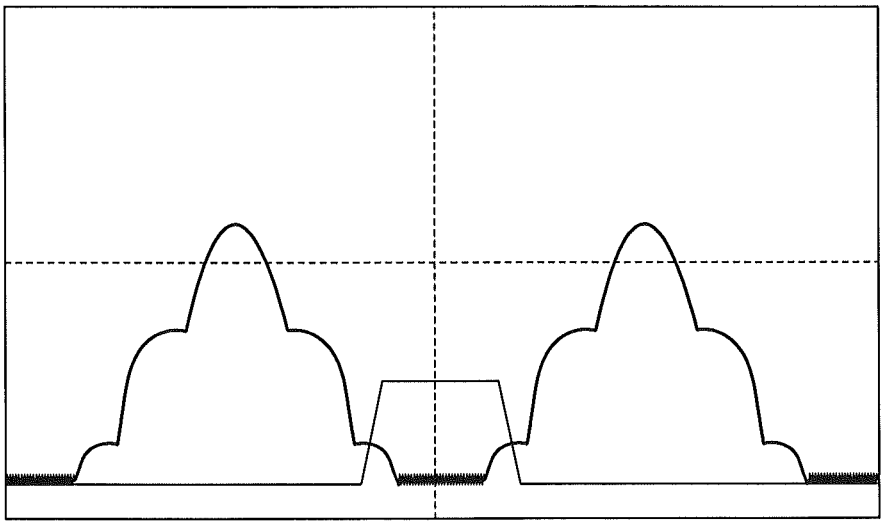
FIG. 2D is a graph illustrating first and second current waveforms generated by driving separate first and second LED strings in some embodiments according to the invention.

FIG. 2D is a graph illustrating first and second current waveforms generated by driving separate first and second LED strings in some embodiments according to the invention. In particular, FIG. 2D shows the current waveform provided to the first LED string 125 (without phase cut dimming) including the "off" time where none of the segments are forward biased. FIG. 2D also shows the current waveform provided to the second LED string 130 during the "off" time, to allow a reduction in the depth of modulation perceived by a viewer. It will be understood that while the current provided to the second LED string 130 may be constant during the at least a portion of the "off" time, the current may cease during times outside the "off" time.

Figure 2E:
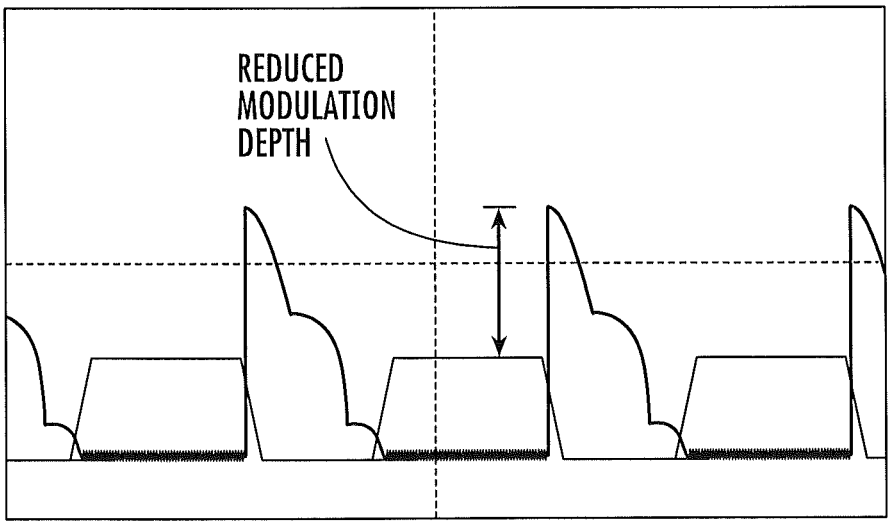
FIG. 2E a graph illustrating first and second current waveforms generated by driving separate first and second LED strings in some embodiments according to the invention.

FIG. 2E a graph illustrating first and second current waveforms generated by driving separate first and second LED strings 125 and 130 in some embodiments according to the invention. In particular, FIG. 2E shows the current waveform provided to the first LED string 125 with phase cut dimming at about 90 degrees of phase, and including the "off" time where none of the segment are forward biased. FIG. 2E also shows the current waveform provided to the second LED string 130 during the phase cut dimming time interval and during the "off" time to allow a reduction in the depth of modulation perceived by a viewer. It will be understood that while the current provided to the second LED string 130 may be constant during at least a portion of the phase cut dimming time interval and during at least a portion of the "off" time, the current may cease during other times.

Figure 3:
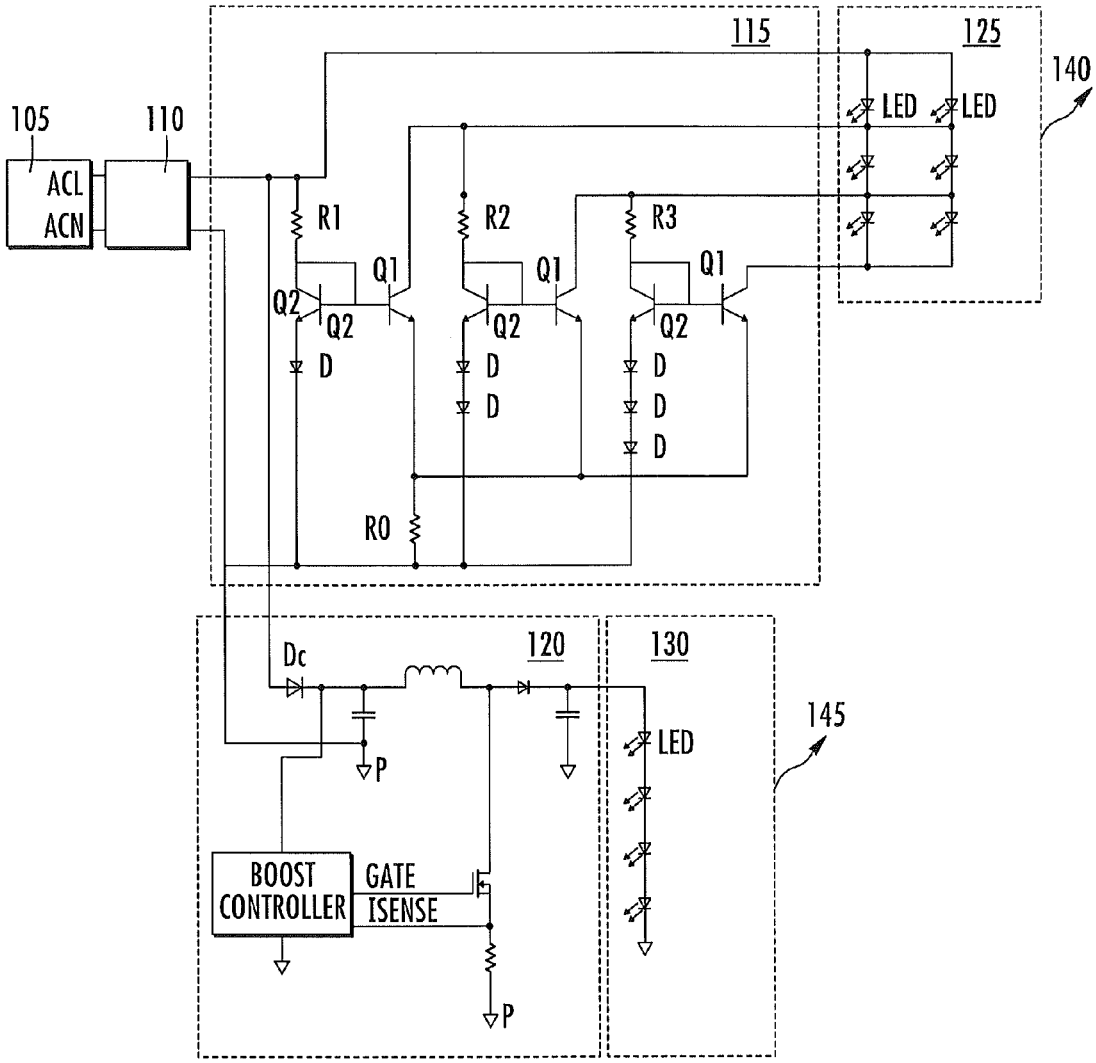
FIG. 3 is a solid state lighting apparatus including a first driver circuit coupled to a first LED string and a second driver circuit coupled to a separate second LED string in some embodiments according to the invention.

FIG. 3 is a circuit schematic diagram illustrating the first and second LED driver circuits 115 and 120 driven by the rectified ac voltage signal 135 provided by the rectifier circuit 110 responsive to operation of the dimmer switch 105 in some embodiments according to the invention. The first LED string 125 includes three segments coupled in series with one another, where each of the segments includes two LEDs coupled in parallel with one another. It will be understood that the segments can include a single LED or multiple LEDs connected in various parallel and/or serial arrangements.

Further, the segments can be separately biased by the first driver circuit 115, so that for example, the first segment can be forward biased once the rectified ac voltage reaches a first particular level, then the first and second segments can both be forward biased once the rectified ac voltage reaches a second particular level, and then the first, second and third segments can all be forward biased when the rectified ac voltage reaches a third particular level, whereupon all segments in the first LED string 125 emit the first light 140. This sequence of biasing is reversed when the phase of the rectified ac voltage passes 90 degrees, whereupon the first LED segment 125 turns off when the first particular level is passed. Accordingly, the biasing of the first LED string 125 is provided according to the phase of the rectified ac voltage. Moreover, the dimmer switch 105 can operate so that the rectified ac voltage 135 is clamped to zero during the phase cut dimming time interval.

As further shown in FIG. 3, the first driver circuit 115 includes respective current diversion circuits that are connected to respective segments of the first LED string 125. The current diversion circuits are configured to provide current paths that bypass the respective segment responsive to the level of the rectified ac voltage. The current diversion circuits each include a transistor Q1 that is configured to provide a controlled current path that may be used to selectively bypass the respective segment to which it is connected. The transistors Q1 are biased using transistors Q2, resistors R1, R2, and R3 and diodes D. The transistors Q2 are configured to operate as diodes, with their base and collector terminals connected to one another. Differing numbers of diodes D are connected in series with the transistors Q2 in respective ones of the current diversion circuits, such that the base terminals of current path transistors Q1 in the respective current diversion circuits are biased at different voltage levels. Resistors R1, R2, and R3 serve to limit base currents for the current path transistors Q1.

The current path transistors Q1 of the respective current diversion circuits will turn off at different emitter bias voltages, which are determined by a current flowing through a resistor R0. Accordingly, the current diversion circuits are configured to operate in response to bias state transitions of the different segments as the rectified ac voltage increases and decreases such that the segments are progressively activated and deactivated as the rectified ac voltage rises and falls. The current path transistors Q1 are turned on and off as bias states of the segments change.

The first LED string 125 may also be coupled in series with a current limiter circuit, such as a current mirror circuit, although any type of current limiter circuit may be used in embodiments according to the invention. One or more storage capacitors may be coupled in parallel with the first LED string and the current mirror circuit. The current mirror circuit may be configured to limit current through the first LED string to an amount that is less than a nominal current provided to the first LED string circuit. This type of configuration is described further in, for example, U.S. application Ser. No. 13/235,103, and in U.S. application Ser. No. 13/360,145, the contents of all of which are incorporated herein by reference.

The second LED string 130 includes four segments coupled in series with one another, where each of the segments includes a single LED. Further, the second LED string 130 can be biased by the second driver circuit 120, so that for example, at least one of the segments can be forward biased during the null time, including the phase cut dimming time interval and/or the off time. It will be understood that although the second driver circuit 120 operates responsive to the rectified ac voltage 135, the second driver circuit 120 can also provide biasing to the second LED string 130 during the phase cut dimming time interval so that the second light 145 is emitted during that time.

As further shown in FIG. 3, the second driver circuit 120 includes a boost controller circuit coupled to a boost circuit configured to control current delivery to the second LED string 130 responsive to a pulse width modulation (PWM) signal. In particular, the boost controller circuit provides the PWM signal to the gate of a transistor that is configured to operate as a switch in controlling the operation of the driver circuit 120. In operation, the transistor turns on/off (i.e., opens and closes) in response to the boost controller circuit PWM signal so that when the transistor in on, the current ramps up in the inductor, while current is provided from the capacitor at the output of driver 120 to the second LED string 130.

When the boost controller circuit turns the transistor off, the current ramp-up in the inductor ceases and the current stored in the inductor is delivered to the capacitor at the output of the driver 120 as well as to the second LED string 130. A diode is provided at the input to the boost circuit, so that the capacitor at the output of the driver 120 is sufficiently charged so that second LED string 130 is provided with current during the phase cut dimming time interval. Accordingly, the second driver circuit 120 operates using the boost controller circuit to provide a constant current to the second LED string 130 during at least a portion of the phase cut dimming time interval and/or during at least a portion of the "off" time.

The amount of current provided to the second LED string 130 can control the level of the second light 145. In particular, the lumen output of the second LED string 130 can be controlled by the duty cycle of the PWM signal provided to the transistor. For example, if the duty cycle of the PWM signal to the transistor is increased, the current provided to the second LED string 130 during the switching of the transistor can increase to provide greater lumen output. If, however, the duty cycle of the PWM signal to the transistor is decreased, the current provided to the second LED string 130 is reduced, to provide less lumen output. Accordingly, the duty cycle of the PWM signal may be changed to, for example, adjust the amount of power delivered to the second LED string 130 by the second driver circuit 120, thereby adjusting the lumen output of the second LED string 130.

The boost controller circuit can also monitor the level of the rectified ac voltage signal to determine whether the level is so low that second LED string 130 drive should be adjusted. For example, if the phase cut dimming time interval becomes too great, the level of the rectified ac voltage signal is reduced so much that the amount of current provided to the second LED string 130 should also be reduced to less than the current waveform through the first LED string 125. The level of the rectified ac voltage signal 135 can be determined using, for example, the RMS value of the signal or by using the value of the phase cut dimming time interval. Other techniques may also be used.

As described herein, the first LED string 125 can include BSY LEDs and can be configured to emit a fraction of the total lumen output of the apparatus 107, whereas the second LED string 130 can include red LEDs and can be configured to output the remaining portion of the total lumen output. For example, the first LED string 125 can include BSY LEDs and can be configured to emit about 80% of the total lumen output of the apparatus 107, whereas the second LED string 130 can include red LEDs and can be configured to output about 20% of total lumen output.

It will be understood that the lumen output from the BSY LEDs and the red LEDs can combine to approximate a white light, by following the planckian locus 106 shown in FIG. 5. Accordingly, the fractions of the total lumen output from the apparatus can be chosen so that the emitted light approximates incandescent lighting by following the planckian locus 106. For example, in some embodiments according to the invention, the apparatus can be configured so that 20% of the total lumen output is produced using red LEDs and 80% is generated using BSY LEDs, so that the emitted light resembles incandescent lighting. Accordingly, it may be more efficient to include the red LEDs in the second LED string because of the cost of the active power conversion associated with the second driver circuit, as only 20% of the power (i.e., lumens) is managed by the active power conversion provided by the second driver circuit etc.

It will be understood, therefore, that the respective lumen outputs provided by the first and second LED strings 125 and 130 can be selected so that the combined light follows the planckian locus 106 shown in FIG. 5. Moreover, the apparatus 107 can also provide for control of color temperature and temperature compensation provided by the combined light output as dimming occurs. Color temperature control and compensation are described in, for example, commonly assigned U.S. patent application Ser. No. 13/416,613, entitled METHODS AND CIRCUITS FOR CONTROLLING LIGHTING CHARACTERISTICS OF SOLID STATE LIGHTING DEVICES AND LIGHTING APPARATUS INCORPORATING SUCH METHODS AND/OR CIRCUITS, filed in the U.S.P.T.O. on Mar. 9, 2012, the entire contents of which are incorporated herein by reference. LED lighting systems to obtain a desired color point are described in U.S. Publication No. 2007/0115662 (Ser. No. 11/368,976) and 2007/0115228 (Ser. No. 11/601410), the disclosures of which are incorporated herein by reference.

It will be understood that the function provided by the boost circuit can be provided by any DC/DC converter circuit, such as a switched mode power supply circuit, a buck converter circuit, a SEPIC power converter circuit, a flyback circuit, or the like.

Figure 6:
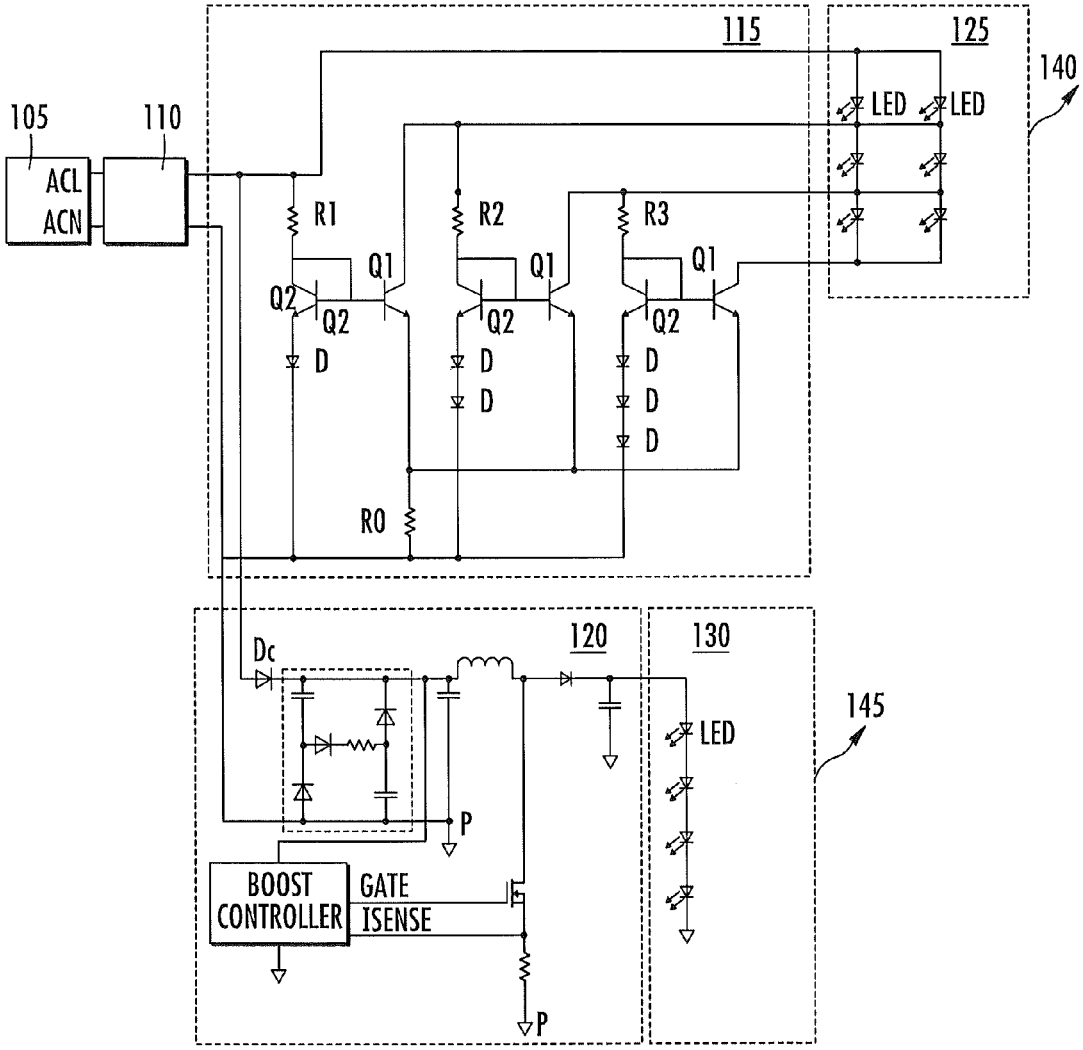
FIG. 6 is a solid state lighting apparatus including a first driver circuit coupled to a first LED string and a second driver circuit coupled to a separate second LED string in some embodiments according to the invention.

FIG. 6 is a solid state lighting apparatus including a first driver circuit coupled to a first LED string and a second driver circuit coupled to a separate second LED string in some embodiments according to the invention, similar to that illustrated in FIG. 3. In particular, a valley fill circuit is provided at the input of the boost circuit. According to FIG. 6, the valley fill circuit is configured to provide a sufficient voltage level at the input of the boost circuit to promote continuous operation and reduce adverse effects of the null times on the power factor of the lighting apparatus.

Figure 4:
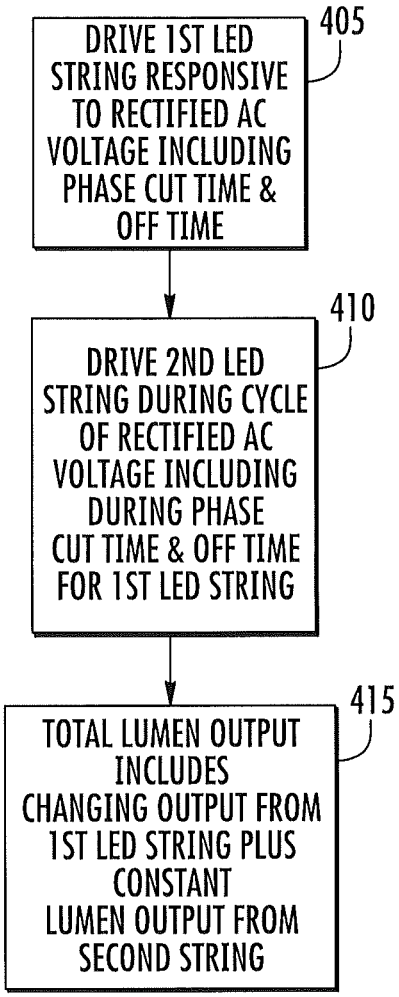
FIG. 4 is a flowchart illustrating operations of a solid state lighting apparatus in some embodiments according to the invention.

FIG. 4 is a flow chart that illustrates operations of the lighting apparatus 107 in some embodiments according to the invention. According to FIG. 4, the first LED string is driven responsive to the rectified ac voltage signal that includes a phase cut dimming time interval as well as an "off" time where the rectified ac voltage signal being too low to forward bias any of the LEDs in the first LED string (block 405).

The second LED string is driven during the null times (i.e., the phase cut dimming time interval and/or during the off time) for the first LED string to provide a second light output from the apparatus (block 410).

The first and second light outputs from the first and second LED strings respectively, can be perceived together to reduce the depth of modulation associated with the phase cut dimming as well as the increased light output during the otherwise off times associated with the first LED string (block 415).

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

It will be understood that, as used herein, the term light emitting diode may include a light emitting diode, laser diode and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive layers.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

What is claimed:

1. A solid state lighting apparatus comprising:

a first string of Light Emitting Diodes (LEDs) configured to operate in response to a rectified ac voltage having a cycle including a null time interval when the first string is off; and a second string of LEDs, separate from the first string of LEDs, configured to emit light during a portion of the null time interval, wherein the null time interval comprises a variable contiguous combination of a phase cut dimming time interval of the cycle and an off time portion of the cycle when a level of the rectified ac voltage is insufficient to forward bias any LED included in the first string of LEDs, the variable contiguous combination being responsive to a phase cut dimmer input.

2. The apparatus of claim 1 further comprising:

a first driver circuit configured to provide a first current to the first string of LEDs that changes with a phase of the rectified ac voltage; and a second driver circuit configured to provide a second current to the second string of LEDs that is substantially constant as the phase of the rectified ac voltage changes.

3. The apparatus of claim 2 wherein the second driver circuit is further configured to provide the second current outside the null time interval.

4. The apparatus of claim 1 further comprising:

a first driver circuit configured to bias the first string of LEDs so that all of the LEDs in the first string of LEDs remain off during the null time interval and configured to forward bias the LEDs in the first string of LEDs according to a sequence outside the null time interval.

5. The apparatus of claim 4 further comprising:

a second driver circuit configured to bias the second string of LEDs so that all of the LEDs in the second string of LEDs remain on during all of the null time interval.

6. The apparatus of claim 4 further comprising:

a second driver circuit configured to bias the second string of LEDs so that at least one of the LEDs in the second string of LEDs is forward biased during all of the null time interval.

7. The apparatus of claim 4 further comprising:

a second driver circuit includes a DC/DC converter circuit configured to bias the second string of LEDs to emit a substantially constant level of light over the cycle of the rectified ac voltage.

8. The apparatus of claim 7 wherein the DC/DC converter circuit comprises a boost circuit coupled to the rectified ac voltage and configured to provide a substantially constant dc current to the second string of LEDs over the cycle of the rectified ac voltage.

9. The apparatus of claim 7 wherein the DC/DC converter circuit comprises a switched mode power supply circuit coupled to the rectified ac voltage and configured to provide a constant dc current to the second string of LEDs over the cycle of the rectified ac voltage.

10. The apparatus of claim 7 wherein the DC/DC converter circuit includes a switch configured to control power delivery to the second string of LEDs by modifying a duty cycle of a pulse width modulation signal provided to the switch, to reduce the constant dc current.

11. The apparatus of claim 1 wherein the first string of LEDs and the second string of LEDs include identical colors of LEDs and the first string of LEDs is configured to emit about a first percent of a total lumen output of the apparatus and the second string of LEDs is configured to emit about a second percent of the total lumen output, wherein the first and second percents are configured to maintain the total lumen output on a black body radiator curve at a respective color temperature.

12. The apparatus of claim 1 wherein the first string of LEDs includes blue-shifted-yellow LEDs configured to output about 80 percent of a total lumen output of the apparatus and the second string of LEDs includes red LEDs configured to output about 20 percent of the total lumen output.

13. The apparatus of claim 1 wherein the second string of LEDs is configured to emit light outside the null time interval when the first string of LEDs is on.

14. A method of operating a solid state lighting apparatus, the method comprising:

driving a first string of Light Emitting Diodes (LEDs) in response to a rectified ac voltage having a cycle including a null time interval when the first string is off; and driving a second string of LEDs, separate from the first string of LEDs, to emit light during at least a portion of the null time interval, wherein the null time interval comprises a variable contiguous combination of a phase cut dimming time interval of the cycle and an off time portion of the cycle when a level of the rectified ac voltage is insufficient to forward bias any LED included in the first string of LEDs, the variable contiguous combination being responsive to a phase cut dimmer input.

15. The method of claim 14 further comprising:

providing a first current to the first string of LEDs that changes with a phase of the rectified ac voltage; and providing a second current to the second string of LEDs that is substantially constant as the phase of the rectified ac voltage changes.

16. The method of claim 15 wherein the second driver circuit is further configured to provide the second current outside the null time interval.

17. The method of claim 14 wherein driving the first string of LEDs comprises biasing the first string of LEDs so that all of the LEDs in the first string of LEDs remain off during the null time interval and to forward bias the LEDs in the first string of LEDs according to a sequence outside the null time interval.

18. The method of claim 17 wherein driving the second string of LEDs comprises biasing the second string of LEDs so that all of the LEDs in the second string of LEDs remain on during all of the null time interval.

19. The method of claim 17 wherein driving the second string of LEDs comprises biasing the second string of LEDs so that at least one of the LEDs in the second string of LEDs is forward biased during all of the null time interval.

20. The method of claim 17 wherein driving the second string of LEDs comprises biasing the second string of LEDs to emit a substantially constant level of the light over the cycle of the rectified ac voltage.

21. The method of claim 20 wherein driving the second string of LEDs comprises providing a substantially constant dc current to the second string of LEDs over the cycle of the rectified ac voltage.

22. The method of claim 21 further comprising:

modifying driving the second string of LEDs to less than a level of the substantially constant dc current as a level of dimming is reduced.

23. The method of claim 22 wherein modifying driving of the second string of LEDs comprises modifying a current provided to the second string of LEDs based on an RMS voltage determined over the cycle responsive to phase cut dimming of the apparatus.

24. The method of claim 22 wherein modifying driving of the second string of LEDs comprises modifying a current provided to the second string of LEDs based on the phase cut dimming time interval during the cycle.

25. The method of claim 14 wherein the first string of LEDs and the second string of LEDs include identical colors of LEDs, wherein driving the first string of LEDs comprises driving the first string of LEDs to emit about a first percent of a total lumen output of the apparatus; and wherein driving the second string of LEDs comprises driving the second string of LEDs to emit about a second percent of the total lumen output, wherein the first and second percents are configured to maintain the total lumen output on a black body radiator curve at a respective color temperature.

26. The method of claim 14 wherein the first string of LEDs includes blue-shifted-yellow LEDs configured to output about 80 percent of a total lumen output of the apparatus and the second string of LEDs includes red LEDs configured to output about 20 percent of the total lumen output.

* * * * *